US008600248B2

(12) United States Patent
Mori

(10) Patent No.: US 8,600,248 B2
(45) Date of Patent: Dec. 3, 2013

(54) IMAGE FORMING APPARATUS

(75) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 388 days.

(21) Appl. No.: 12/945,075

(22) Filed: Nov. 12, 2010

(65) Prior Publication Data

US 2011/0123202 A1 May 26, 2011

(30) Foreign Application Priority Data

Nov. 24, 2009 (JP) ..... 2009-266301

(51) Int. Cl.
*G03G 15/00* (2006.01)

(52) U.S. Cl.
CPC ..... *G03G 15/5058* (2013.01)
USPC ..... 399/49

(58) Field of Classification Search
USPC ..... 399/49
See application file for complete search history.

(56) References Cited

U.S. PATENT DOCUMENTS

| | | | | |
|---|---|---|---|---|
| 5,867,759 | A | 2/1999 | Isobe et al. | |
| 6,185,386 | B1 * | 2/2001 | Noguchi | 399/49 |
| 6,920,303 | B2 | 7/2005 | Yamanaka et al. | |
| 7,203,433 | B2 * | 4/2007 | Kato et al. | 399/49 |
| 7,848,688 | B2 | 12/2010 | Murayama | |
| 2001/0031148 | A1 * | 10/2001 | Kajiwara et al. | 399/49 |
| 2002/0136570 | A1 | 9/2002 | Yamanaka et al. | |
| 2004/0033090 | A1 | 2/2004 | Yamanaka et al. | |
| 2008/0240798 | A1 | 10/2008 | Murayama | |

FOREIGN PATENT DOCUMENTS

| | | | |
|---|---|---|---|
| JP | 10-073981 | | 3/1998 |
| JP | 2001-272835 | | 10/2001 |
| JP | 2002-207338 | | 7/2002 |
| JP | 2003-098848 | | 4/2003 |
| JP | 2004-012549 | A | 1/2004 |
| JP | 2004-309687 | | 11/2004 |
| JP | 2006-072007 | A | 3/2006 |
| JP | 2006-267548 | A | 10/2006 |
| JP | 2007-148080 | | 6/2007 |
| JP | 2007-232763 | A | 9/2007 |
| JP | 2008-242375 | A | 10/2008 |
| JP | 2009-042473 | | 2/2009 |

OTHER PUBLICATIONS

JP Office Action dtd Nov. 15, 2011, JP Appln. 2009-266301, English translation.
JP Office Action dtd May 22, 2012, JP Appln. 2009-266301, English translation.

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus includes: a belt; a plurality of photosensitive units that contact the belt are disposed at a predetermined interval in the transportation direction of the belt and transfer marks for image adjustment to the belt, images of different colors being respectively formed on the plurality of photosensitive units; an exposure unit that exposes the photosensitive units by light so that the marks are disposed at the same interval on the belt; a detector that detects the marks transferred to the belt; and an image adjustment unit that performs an image adjustment based on a detection result of the detector. A width and an interval of the marks in the transportation direction are set so that a mark of at least one color does not exist in all contact areas of the belt contacting the plurality of photosensitive units.

11 Claims, 10 Drawing Sheets

IMAGE FORMING APPARATUS

CROSS-REFERENCE OF APPLICATION

This application is based upon and claims the benefit of priority of Japanese Patent Application No. 2009-266301 filed on Nov. 24, 2009, the contents of which are incorporated herein by reference in its entirety.

BACKGROUND OF THE INVENTION

The present invention relates to an image forming apparatus that forms a color image by overlapping a plurality of images. More specifically, the present invention relates to an image forming apparatus that forms a mark for image adjustment on a transportation belt disposed while coming into contact with a photosensitive unit used for forming an image.

In the past, in an image forming apparatus having a color printing function, a color image is formed in such a manner that images of colors of cyan (C), magenta (M), yellow (Y), and black (K) are formed and overlapped with each other. Likewise, since the plurality of images needs to be overlapped with each other, an electrophotographic type image forming apparatus performs an image adjustment so that a difference does not occur in the positions or concentrations of the images. As for the image adjustment, for example, a resist pattern as a mark for image adjustment is formed for each color, an offset amount (adjustment value) between the resist patterns of a reference color and an adjustment color is obtained, and then the positional offset of the image is corrected on the basis of the adjustment value.

Further, in the image forming apparatus that forms the mark on a transportation belt, when there is a disturbance area such as rubbing traces on the transportation belt, detection precision of the image pattern is degraded due to the damaged portion, and hence correction precision is degraded. As a technology designed to solve this problem, for example, a related image forming apparatus detects an area without disturbances on a transportation belt, and forms a resist pattern on the area without disturbances.

SUMMARY OF THE INVENTION

In the image adjustment process performed by forming the image pattern on the transportation belt, the state of the surface of the transportation belt affects detection precision. An example of factors degrading the surface state includes rubbing trace caused by a contact between a photosensitive unit and the transportation belt. Particularly, after factory shipment, the photosensitive unit keeps coming into contact with the same position on the transportation belt until a user receives the image forming apparatus, and the characteristics of the contact position markedly change due to vibrations during delivery.

In order to suppress an influence of scratches between the photosensitive unit and the transportation belt, a method may be supposed in which an area without the rubbing trace is detected and the image pattern is formed in that area as in the related image forming apparatus. However, in the image adjustment, particularly when there is a plurality of rubbing traces, the process becomes complicated since the image pattern needs to be determined to avoid the areas with the rubbing traces.

The present invention is contrived to solve the aforementioned problems of the existing image forming apparatus. That is, an object of the invention is to provide an image forming apparatus capable of simply performing an image adjustment in which the influence of the disturbance area on the transportation belt is suppressed.

According to an aspect of the invention, an image forming apparatus includes:

a belt;

a plurality of photosensitive units that contact the belt, are disposed at a predetermined interval in the transportation direction of the belt and transfer marks for image adjustment to the belt, images of different colors being respectively formed on the plurality of photosensitive units;

an exposure unit that exposes the photosensitive units by light so that the marks are disposed at the same interval on the belt;

a detector that detects the marks transferred to the belt; and an image adjustment unit that performs an image adjustment based on a detection result of the detector, wherein a width and an interval of the marks in the transportation direction are set so that a mark of at least one color does not exist in all contact areas of the belt contacting with the plurality of photosensitive units.

According to an aspect of the invention, an image forming apparatus includes:

a belt;

a plurality of photosensitive units that contact the belt, are disposed at a predetermined interval in the transportation direction of the belt and transfer marks for image adjustment to the belt, images of different colors being respectively formed on the plurality of photosensitive units;

an exposure unit that exposes the photosensitive units by light so that the marks are disposed at the same interval on the belt;

a detector that detects the marks transferred to the belt; and an image adjustment unit that performs an image adjustment based on a detection result of the detector, wherein at least one of the following conditions is not satisfied:

$W>L-P$; and $D(B-1)+W+P>nL(B-1)>D(B-1)-W-P$ where n is a natural number and satisfies $n\leq X/(B-1)$, where L represents interval of the marks is denoted by L, P represents a width of the marks in the transportation direction, D represents a distance between the adjacent photosensitive units, W represents a width of a contact area between the belt and the photosensitive unit in the transportation direction, X represents a total number of the marks, and B represents a number of the photosensitive units.

According to an aspect of the invention, an image forming apparatus includes:

a belt;

a plurality of photosensitive units that contact the belt, are disposed at a predetermined interval in the transportation direction of the belt and transfer marks for image adjustment to the belt, images of different colors being respectively formed on the plurality of photosensitive units;

an exposure unit that exposes the photosensitive units by light so that the marks are disposed at the same interval on the belt;

a detector that detects the marks transferred to the belt; and an image adjustment unit that performs an image adjustment based on a detection result of the detector, wherein at least one of the following conditions is satisfied:

an integer A satisfying $DA+W+P<nL<D(A+1)-W-P$ for all n when $0<A\leq(B-1)$, and an integer A satisfying $DA+W+P<nL$ for all n when $A=B-1$, where L represents an interval of the marks, P represents a width of the marks in the transportation direction, D represents a distance between the photosensitive units, W represents a width of the contact area between the belt and the photosensitive unit in the transportation direction, X represents a total number of the marks, and B represents a number of the photosensitive units, and n is set to a natural number of 1 to X−1.

DETAILED DESCRIPTION OF PREFERRED EMBODIMENTS

Hereinafter, an image forming apparatus according to the exemplary embodiment will be described in detail with reference to the accompanying drawings. In these embodiments, the invention is applied to an electrophotographic type copying machine that forms a color image by using toner having four colors of yellow (Y), magenta (M), cyan (c), and black (K).

Entire Configuration of Copying Machine

Figure 1:
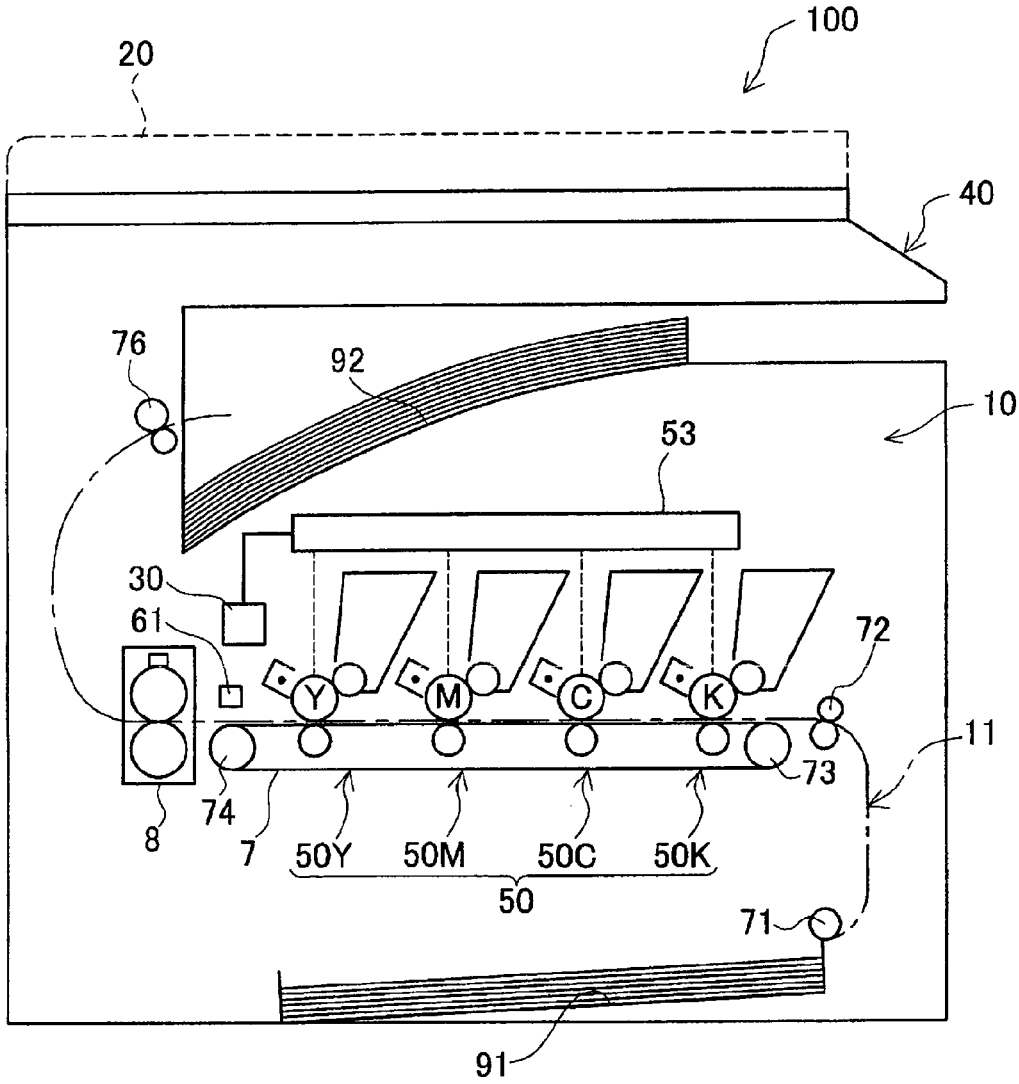
FIG. 1 is a conceptual diagram illustrating a schematic configuration of a copying machine according to the embodiments.

As shown in FIG. 1, a copying machine 100 includes an image forming unit 10 which forms an image on a sheet, and an image reading unit 20 which reads an image of a document. The image forming unit 10 includes a process section 50 which forms a toner image and transfers the toner image onto a sheet, a fixation device 8 which fixes toner not fixed onto the sheet, a sheet feeding tray 91 which places the sheet not subjected to the image transfer operation thereon, and a sheet discharging tray 92 which places the sheet subjected to the image transfer operation thereon.

A substantially S-shaped transportation path 11 (depicted by the dashed-dotted line of FIG. 1) is provided inside the image forming unit 10 so that the sheet received in the sheet feeding tray 91 located at the bottom portion of the image forming unit is guided to the sheet discharging tray 92 located at the upper portion of the image forming unit by a sheet discharging roller 76 via a sheet feeding roller 71, a resist roller 72, the process section 50, and the fixation device 8.

The process section 50 is capable of forming a color image, and has a structure in which process sections corresponding to the colors of yellow (Y), magenta (M), cyan (C), and black (K) are arranged in parallel. Specifically, the process section 50 includes a process section 50Y which forms an image of color Y, a process section 50M which forms an image of color M, a process section 50C which forms an image of color C, and a process section 50K which forms an image of color K. Then, the respective process sections 50Y, 50M, 50C, and 50K are arranged with a predetermined interval therebetween in the transportation direction of the sheet.

The image forming unit 10 includes an exposure device 53 (an example of an exposure unit) which emits light to the respective process sections 50Y, 50M, 50C, and 50K, a transportation belt 7 (an example of a belt) which transports the sheet to the transfer position of each of the process sections 50Y, 50M, 50C, and 50K, and a mark sensor 61 (an example of a detector) which detects a resist pattern formed on the transportation belt 7.

The transportation belt 7 is an endless belt member which is suspended on transportation rollers 73 and 74, and is formed of a resin material such as polycarbonate. The transportation belt 7 is moved in circulation in the counter-clockwise direction of the paper surface of the drawing when the transportation roller 74 is rotationally driven. Accordingly, the sheet placed on the upper surface of the transportation belt is transported from the resist roller 72 to the fixation device 8.

The mark sensor 61 is located on the downstream side of the process sections 50Y, 50M, 50C, and 50K in the transportation direction of the sheet, and is located on the upstream side of the fixation device 8 so as to detect the resist pattern formed on the transportation belt 7. The mark sensor 61 will be described in detail later.

Figure 2:
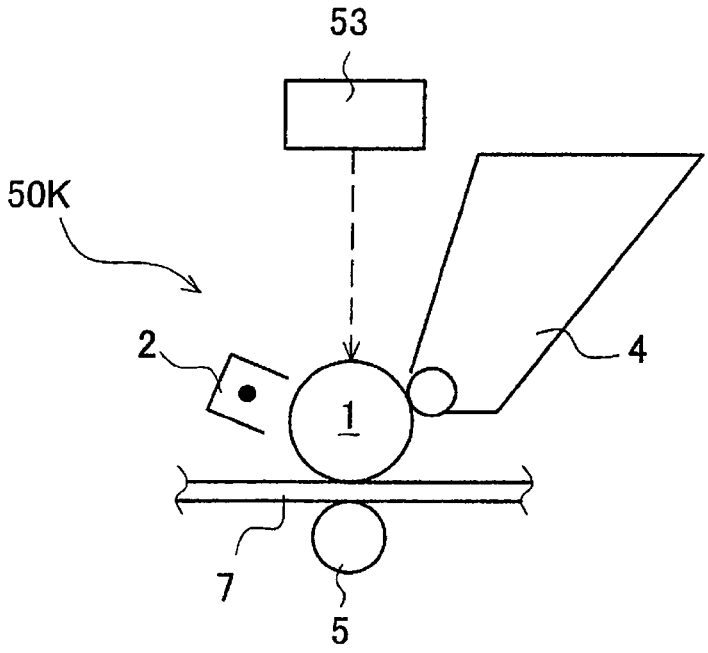
FIG. 2 is a conceptual diagram illustrating a configuration of a process section of the copying machine shown in FIG. 1.

The process sections 50Y, 50M, 50C, and 50K form a toner image by the use of the known electrophotographic method. As shown in FIG. 2, the process section 50K includes a photosensitive unit 1 which is formed in a drum shape, a charging device 2 which equally charges the surface of the photosensitive unit 1, a developing device 4 which develops an electrostatic latent image by the use of toner, and a transfer device 5 which transfers the toner image on the photosensitive unit 1 to the sheet. The photosensitive unit 1 and the transfer device 5 are disposed while coming into contact with the transportation belt 7. Then, the photosensitive unit 1 is opposite the transfer device 5 with the transportation belt 7 interposed therebetween. The process sections 50Y, 50M, and 50C also have the same configurations as that of the process section 50K.

In the process section 50, the surface of the photosensitive unit 1 is equally charged by the charging device 2. Then, the surface of the photosensitive unit is exposed by light generated from the exposure device 53, so that an electrostatic latent image of an image to be formed on the sheet is formed on the surface. Subsequently, the toner is supplied to the photosensitive unit 1 via the developing device 4. Accordingly, the electrostatic latent image of the photosensitive unit 1 is visualized as a toner image.

The image forming unit 10 extracts one by one the sheets stacked on the sheet feeding tray 91, and transports the sheet onto the transportation belt 7. Then, the toner image formed by the process section 50 is transferred onto the sheet. At this time, in color printing, the toner images are formed by the process sections 50Y, 50M, 50C, and 50K, and are overlapped with each other on the sheet. On the other hand, in monochrome printing, the toner image is formed only by the process section 50K, and is transferred onto the sheet. Subsequently, the sheet having the toner image transferred thereto is transferred to the fixation device 8, and the toner image is thermally fixed onto the sheet. Then, the sheet having the image fixed thereto is discharged to the sheet discharging tray 92.

Configuration of Mark Sensor

Figure 3:
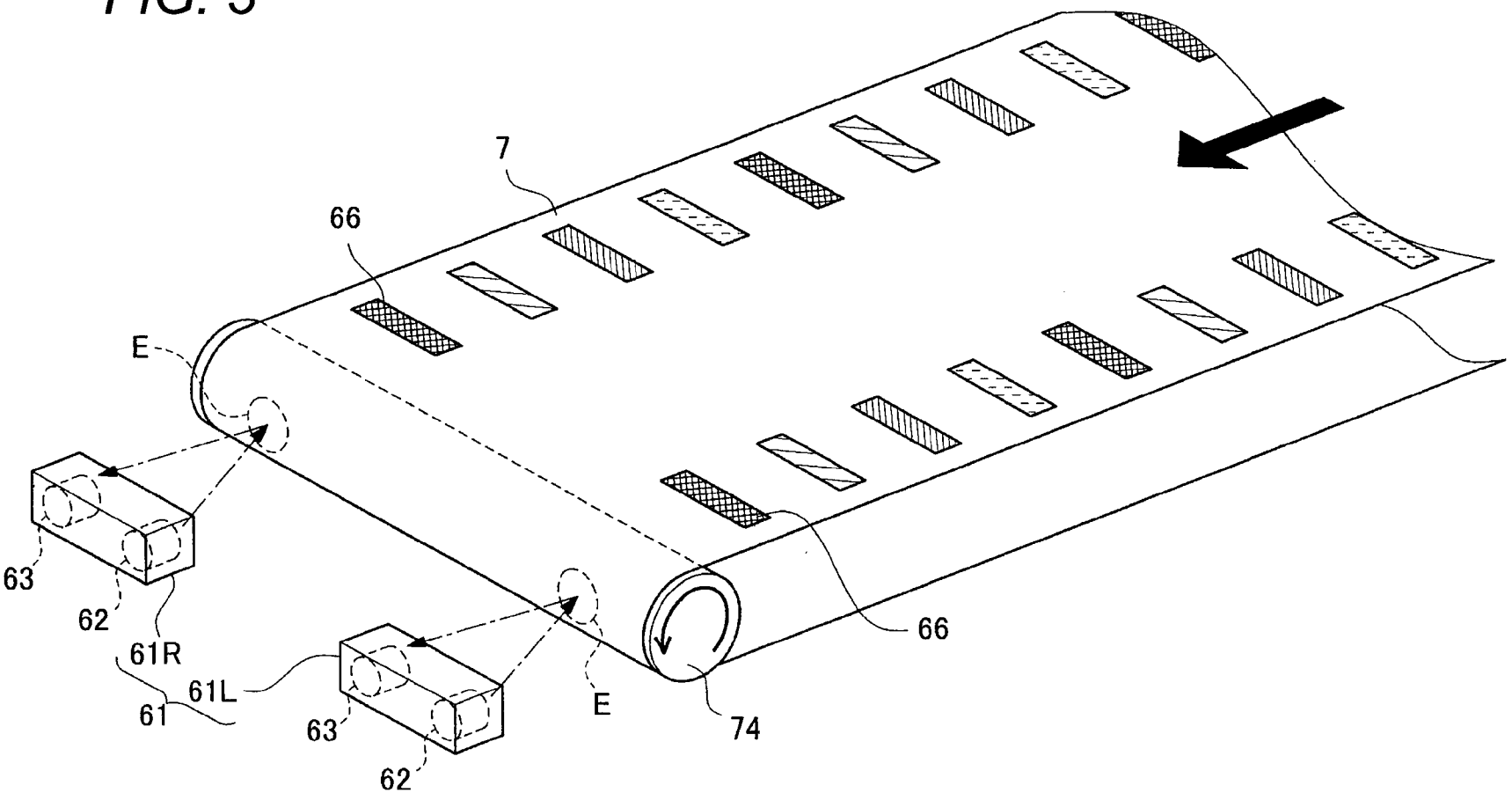
FIG. 3 is a conceptual diagram illustrating the arrangement of mark sensors of the copying machine shown in FIG. 1.

Subsequently, the mark sensor 61 will be described. As shown in FIG. 3, the mark sensor 61 includes two sensors, where a sensor 61R is disposed on the right in the width direction of the transportation belt 7, and a sensor 61L is disposed on the left.

Each of the sensors 61R and 61L is a reflection type optical sensor having a pair of light emitting element 62 (for example, an LED) and a light receiving element 63 (for example, a phototransistor). In the mark sensor 61, light is emitted in an oblique direction from the light emitting element 62 to the surface (the dotted circle E of FIG. 3) of the transportation belt 7, and the light is received by the light receiving element 63.

The output level of the light receiving element 63 becomes higher as the level of the light receiving amount of the light receiving element 63 becomes higher, and the output level becomes lower as the level of the light receiving amount of the light receiving element 63 becomes lower. The mark sensor 61 compares the signal output from the light receiving element 63 with a predetermined threshold value, and outputs the signal as a binary signal.

The mark sensor 61 receives light reflected from the transportation belt 7 while detecting an area where a resist pattern 66 is not formed. For this reason, the light receiving amount of the light receiving element 63 is large, and the output level of the light receiving element 63 is high. On the other hand, the mark sensor 61 receives light reflected from the toner image while detecting an area where the resist pattern 66 is formed. The light reflected from the toner image has many scattered reflection components compared with the light reflected from the transportation belt 7. For this reason, the light receiving amount of the light receiving element 63 is decreased, and the output level of the light receiving element 63 is decreased. The resist pattern 66 can be detected by determining a variation in the output level.

Electrical Configuration of Copying Machine

Figure 4:
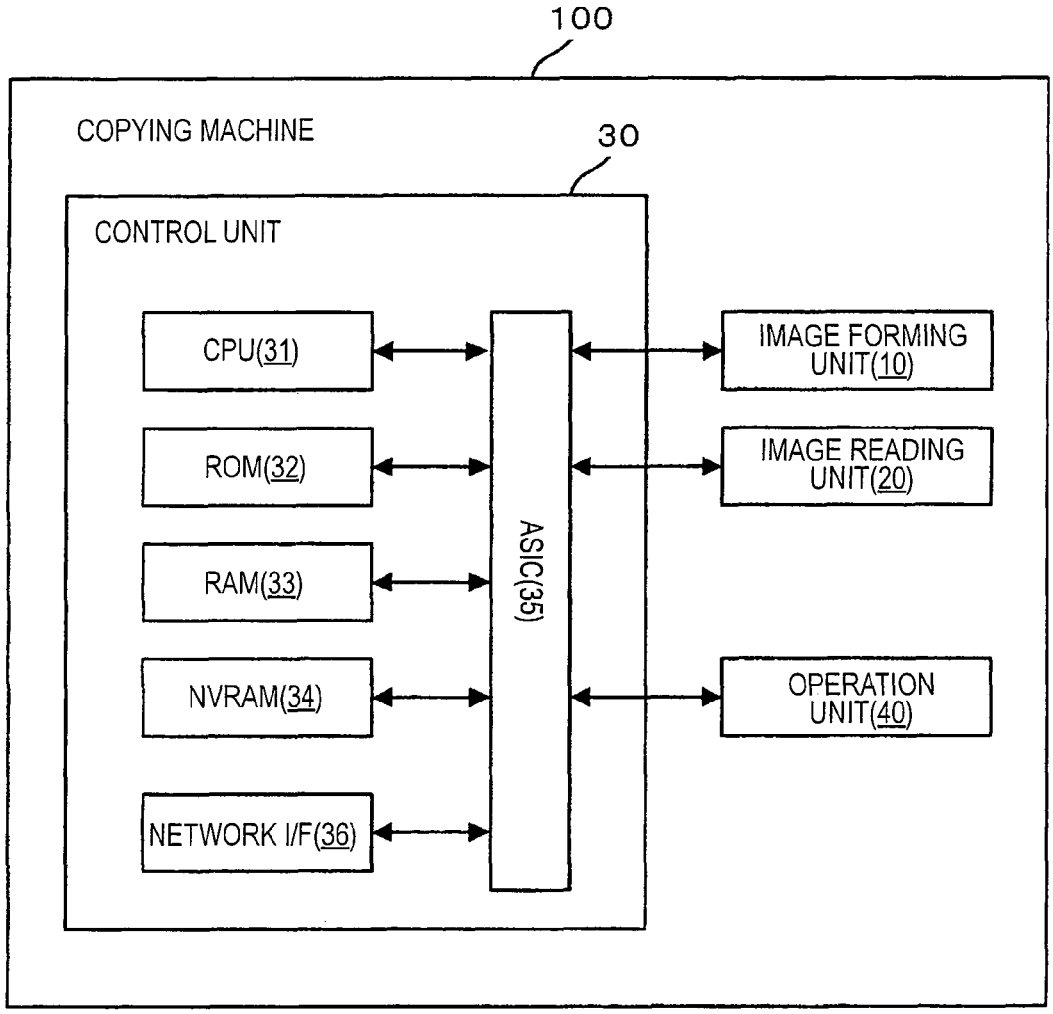
FIG. 4 is a block diagram illustrating an electrical configuration of the copying machine shown in FIG. 1.

Subsequently, the electrical configuration of the copying machine 100 will be described. As shown in FIG. 4, the copying machine 100 includes a control unit 30 (an example of an image adjustment unit) having a CPU 31, a ROM 32, a RAM 33, an NVRAM (non-volatile RAM) 34, an ASIC 35, and a network interface 36. The control unit 30 is electrically connected to the image forming unit 10, the image reading unit 20, the operation unit 40, and the like. The image forming unit 10, the image reading unit 20, and the operation unit 40 are controlled by the control unit 30, and are independently operated.

The ROM 32 stores various control programs for controlling the copying machine 100, various settings, or initial values. The RAM 33 is used as a working area where various control programs are read or a storage area where image data is temporarily stored.

The CPU 31 controls the respective components (for example, switch-on timing of the exposure device 53, driving motors (not shown) of various rollers constituting the transportation path 11, movement motors (not shown) of image sensors constituting the image reading unit 20) of the copying machine 100 via an ASIC 35 while storing the process results in the RAM 33 or the NVRAM 34 in response to the signals transmitted from various sensors or the control program read from the ROM 32.

The network interface 36 is connected to a network such as a LAN, and enables a connection to an external device having a driver for the copying machine 100 installed therein. The copying machine 100 is capable of transmitting and receiving print jobs via the network interface 36.

Image Adjustment

Configuration of Resist Pattern

Figure 5:
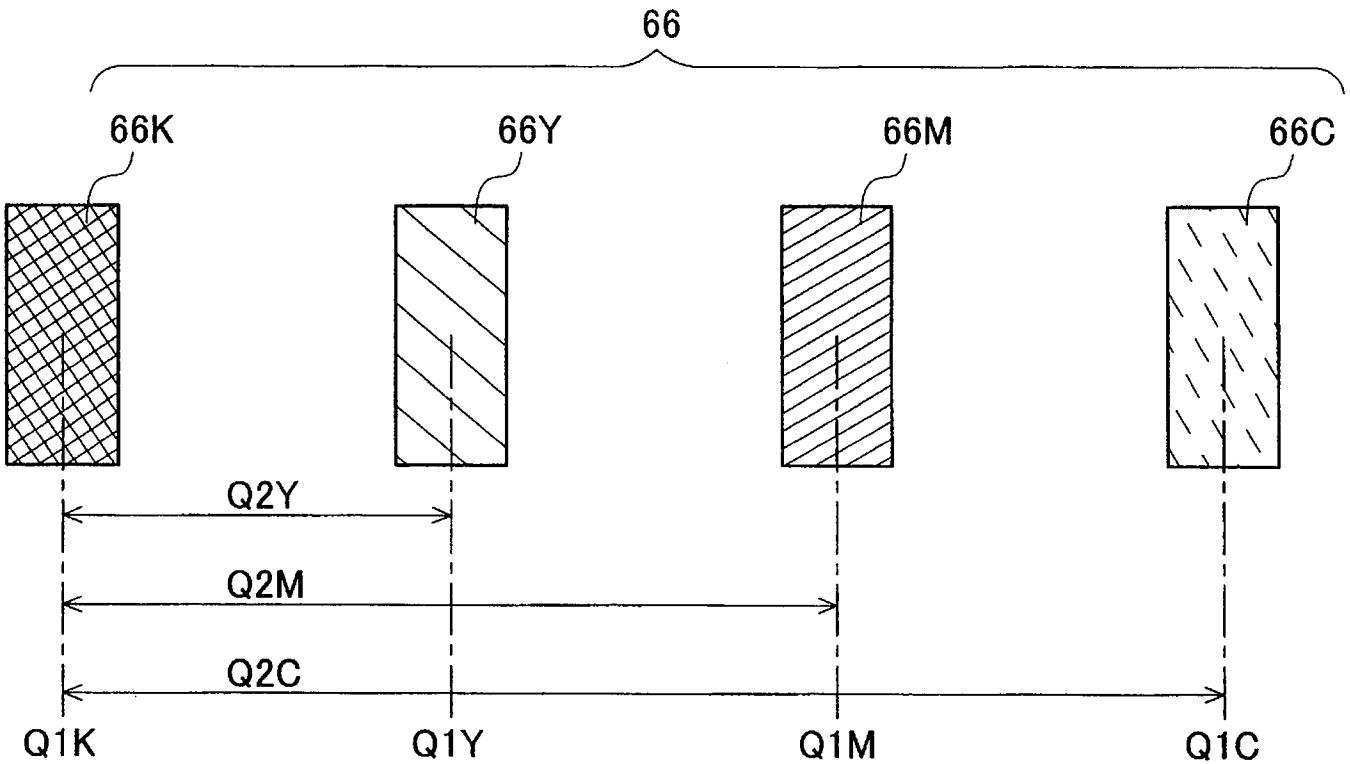
FIG. 5 is a diagram illustrating an example of a resist pattern formed on a transportation belt.

Subsequently, the configuration of the resist pattern formed on the transportation belt 7 will be described. FIG. 5 illustrates the configuration of the resist pattern 66 according to the embodiment. In FIG. 5, the left/right direction is the movement direction (secondary scanning direction) of the transportation belt 7, and the up/down direction is the width direction (primary scanning direction) of the transportation belt 7.

The resist pattern 66 is used to measure a positional offset amount in the secondary scanning direction between the images formed by the process sections 50Y, 50M, 50C, and 50K. In this embodiment, the color K is set as a reference color, and the colors YMC are set as adjustment colors. That is, the positional offset amount between colors is corrected by adjusting the image forming positions of the respective colors YMC on the basis of the image forming position of the color K.

Specifically, the resist pattern 66 includes a group of marks obtained by sequentially arranging in the secondary scanning direction a mark 66K formed by the process section 50K, a mark 66Y formed by the process section 50Y, a mark 66M formed by the process section 50M, and a mark 66C formed by the process section 50C. A plurality of the resist patterns 66 is formed at the same interval in the secondary scanning direction. Each of the marks 66K, 66Y, 66M, and 66C is formed in a rectangular bar shape, and is disposed in the primary scanning direction.

The control unit 30 calculates middle positions Q1K, Q1Y, Q1M, and Q1C of the marks 66K, 66Y, 66M, and 66C on the basis of the binary signals output from the mark sensor 61.

Next, the distances from the mark 66K as the reference color to the middle positions (Q1K-Q1Y, Q1K-Q1M, and Q1K-Q1C) of the marks 66Y, 66M, and 66C as the adjustment colors in the secondary scanning direction are denoted by mark distances Q2Y, Q2M, and Q2C, respectively. The mark distances Q2Y, Q2M, and Q2*c* are changed due to occurrence of the positional offset in the secondary scanning direction. Accordingly, it is possible to specify the positional offset amount in the secondary scanning direction of each of the adjustment colors with respect to the reference color.

The configuration of the resist pattern 66 is merely an example, and the invention is not limited thereto. The mark formed on the transportation belt 7 may be a general image pattern which is used for the positional offset correction or concentration correction.

Disturbance Area

Subsequently, the disturbance area existing on the surface of the transportation belt 7 will be described. A plurality of areas exists on the surface of the transportation belt 7 where characteristics may be changed due to scratch marks from the photosensitive unit 1.

For example, since the transportation belt 7 is immovable until a user starts to use the copying machine after the factory shipment thereof, each of the photosensitive units 1 keeps coming into contact with the same position on the transportation belt 7. The contact position between the transportation belt 7 and the photosensitive unit 1 may become glossy due to vibrations generated during delivery after the factory shipment. That is, the contact position during delivery corresponds to the disturbance area. In this embodiment, the portion where each photosensitive unit 1 currently comes into contact with the surface of the transportation belt 7 is referred to as a "contact area", and the contact portion of each photosensitive unit 1 during delivery is referred to as a "disturbance area".

Figure 6:
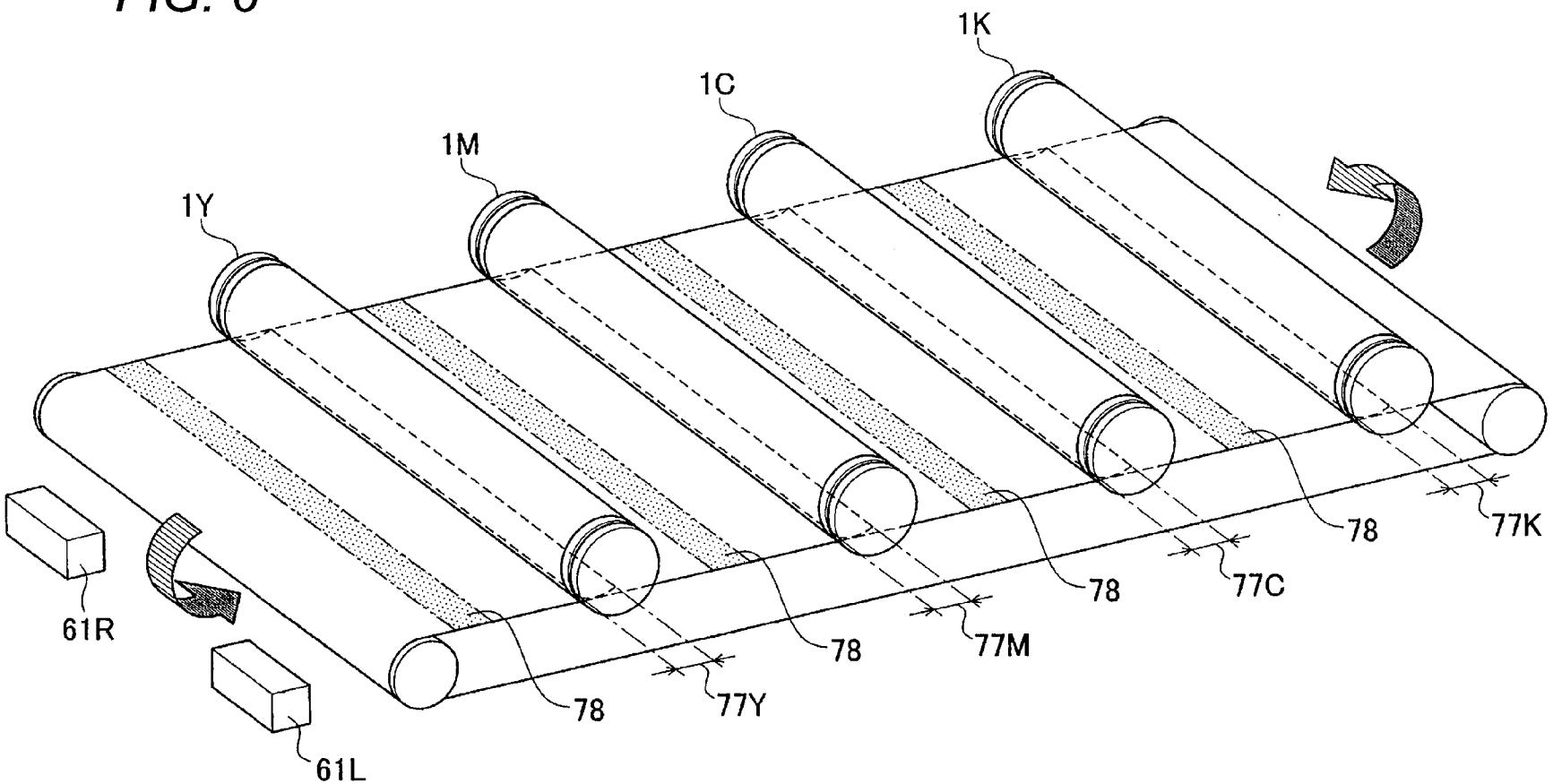
FIG. 6 is a diagram illustrating the arrangement of disturbance areas existing on the transportation belt.

Specifically, as shown in FIG. 6, the copying machine 100 includes four photosensitive units 1K, 1Y, 1M, and 1C. The photosensitive units 1K, 1Y, 1M, and 1C are arranged at a predetermined interval in the transportation direction of the transportation belt 7, and are disposed while coming into contact with the transportation belt 7 in the width direction of the transportation belt 7. That is, the surface of the transportation belt 7 is provided with contact areas 77K, 77Y, 77M, and 77C respectively coming into contact with the photosensitive units 1K, 1Y, 1M, and 1C. When the color (photosensitive unit) is not distinguished in the description below, it will be mentioned as the "contact area 77".

The surface of the transportation belt 7 is provided with four disturbance areas 78. The disturbance areas 78 are the portions which originally come into contact with the photosensitive units 1K, 1Y, 1M, and 1C during delivery, and have the same widths as those of the contact areas 77. The interval between the disturbance areas 78 and 78 is equal to the interval between the contact areas 77 and 77. The disturbance areas 78 are moved with the movement of the transportation belt 7.

When the disturbance areas 78 exist on the transportation belt 7 as described above, the output of the mark sensor 61 is influenced as below. That is, during the time when the "non-disturbance area" (which is not the disturbance area 78, and the formation area of the resist pattern 66) of the surface of the transportation belt 7 is detected, the light receiving amount is equal, and the output level of the mark sensor 61 is stable.

Figure 7:
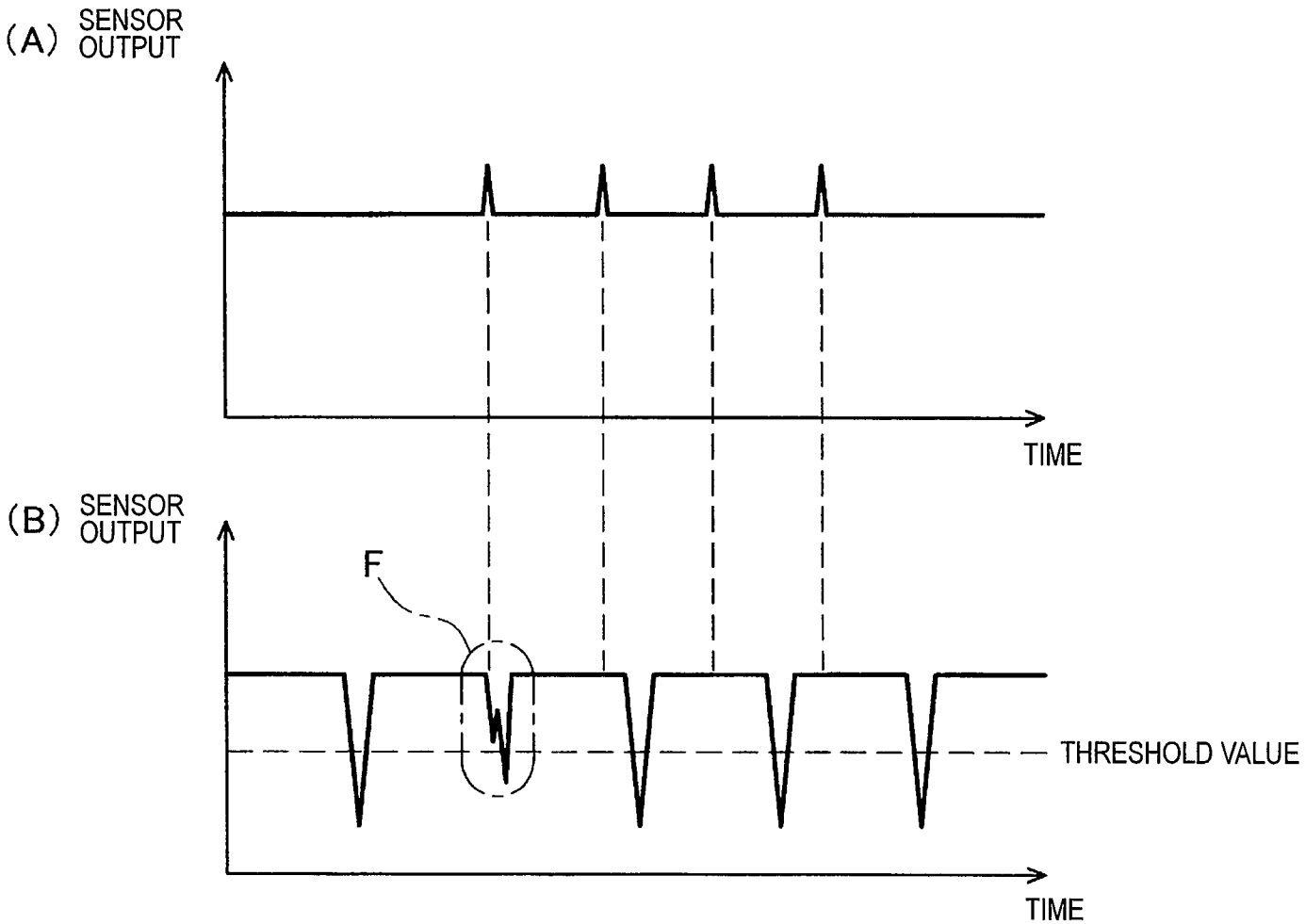
FIG. 7 is a diagram illustrating an output example of the mark sensor.

On the other hand, the gloss of the disturbance area 78 of the surface of the transportation belt 7 is high compared with the non-disturbance area. For this reason, when detecting the disturbance area 78, the light receiving amount increases compared with the non-disturbance area. When detecting the disturbance area 78 as shown in FIG. 7A, the output level of the mark sensor 61 increases.

When detecting the portion of the resist pattern 66, the light receiving amount decreases compared with the non-disturbance area, and the output level of the mark sensor 61 decreases. That is, as shown in FIG. 7B, the resist pattern 66 can be detected by the use of the principle that the output of the mark sensor 61 decreases to be lower than the threshold value.

However, in some cases, the resist pattern 66 may be formed in the high-glossy disturbance area 78 (as depicted by the dotted circle F of FIG. 7), and the output of the mark sensor 61 may not decrease to be lower than the threshold value even after the passage of the resist pattern 66. That is, the position of the resist pattern 66 may not be accurately detected in some cases.

Arrangement of Resist Pattern

Subsequently, the arrangement example of the resist pattern 66 in consideration of the position of the disturbance area 78 will be described. As described above, it is desirable that as far as possible the resist pattern 66 is not formed on the disturbance area 78. Therefore, the arrangement example of avoiding the formation of the resist pattern 66 on the disturbance area 78 will be described.

Specifically, the next two embodiments will be described as the arrangement example of the mark 66K of color K. That is, in the first embodiment, the marks 66K do not exist simultaneously in the contact areas 77K, 77Y, 77M, and 77C existing at four positions, that is, the mark 66K does not exist in at least one of the contact areas 77K, 77Y, 77M, and 77C at any timing. In the second embodiment, the number of the marks 66K simultaneously existing in the contact areas 77K, 77Y, 77M, and 77C existing at four positions is one at maximum.

(First Embodiment)

In order to realize the arrangement of the first embodiment, first, the condition that the marks 66K are not simultaneously disposed at all the contact areas 77K, 77Y, 77M, and 77C of four positions is obtained. Therefore, when the interval (pitch) of the mark 66K is denoted by L, the width of the transportation direction of the mark 66K is denoted by P, the distance (pitch) between the photosensitive units 1 is denoted by D, and the width of the transportation direction of the contact area 77 is denoted by W, the condition wherein the marks 66K are surely disposed at four positions can be expressed by the following equation (1).

$$W>L-P \tag{1}$$

That is, when the marks 66K are formed in a condition where the minimum distance (L−P) between the marks 66K is narrower than the width W of the contact area 77, the marks 66K are surely disposed at all four positions of the contact areas 77K, 77Y, 77M, and 77C.

Figure 8:
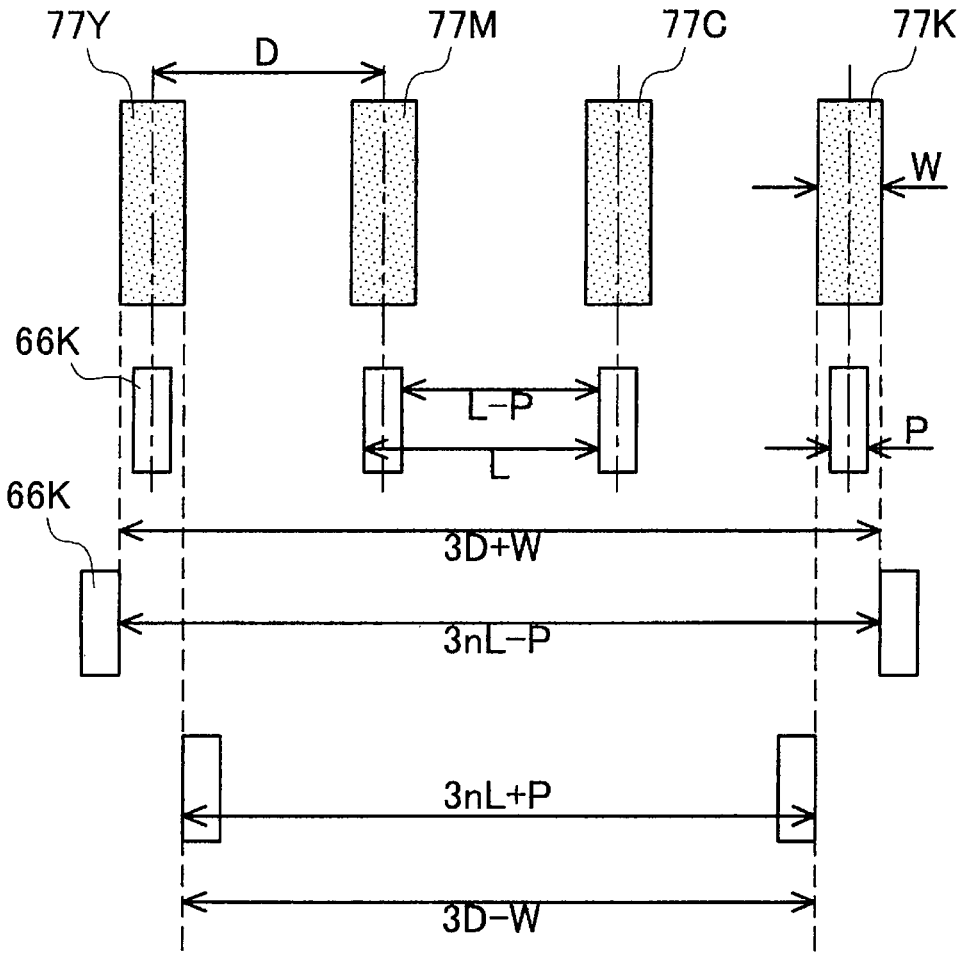
FIG. 8 is a diagram illustrating conditions (1) and (2) that a mark surely overlaps with a contact area according to the first embodiment.

In order to dispose the marks 66K at four positions in the condition that the minimum distance (L−P) between the marks 66K is wider than the width W of the contact area, it is necessary to obtain conditions that the mark 66K is disposed close to the outside and inside of both contact areas 77K and 77Y in the area from the contact area 77K located on the most upstream side of the transportation direction of the transportation belt 7 to the contact area 77Y located on the most downstream side as shown in FIG. 8.

Therefore, the condition that the mark 66K contacts the outside of the contact area 77K and the contact area 77Y can be expressed by the following equation (2').

$$3D+W>3nL-P \tag{2'}$$

On the other hand, the condition that the mark 66K contacts the inside of the contact area 77K and the contact area 77Y can be expressed by the following equation (2").

$$3D-W<3nL+P \tag{2''}$$

The integer "3" of the equations (2') and (2") is equal to the number of contact area 77−1, that is, the number B of photosensitive units 1−1.

When the equations (2') and (2") are combined, the following equation (2) can be obtained.

$$3D+W+P>3nL>3D-W-P \tag{2}$$

When there is a natural number n satisfying the equation (2), the marks 66K are formed in all the contact areas 77K, 77C, 77M, and 77Y of four positions. However, when the total number of the formed marks 66K is too small, it is not supposed that the marks 66K are formed at four positions even when the condition (2) is satisfied. For this reason, when the total number of the marks 66K is denoted by X, the natural number n satisfies $n \leq X/3$.

All the equations (1) and (2) are conditions that the marks 66K are formed at all the contact areas 77K, 77C, 77M, and 77Y of four positions. Accordingly, when the interval L and the width P of the mark 66K are set so as not to satisfy the equations (1) and (2), it is possible to avoid that the marks 66K are disposed at all four positions of the contact areas 77K, 77C, 77M, and 77Y. As a result, it is possible to avoid the marks 66K being formed at all the disturbance areas 78 of four positions. Accordingly, the negative effects of the disturbance area 78 can be alleviated.

Further, in this embodiment, the mark 66K of color K is described, but the invention is not limited thereto. When the marks 66Y, 66M, and 66C of other colors are disposed in the same manner, detection precision for that color can be improved. When marks of the four colors are formed so as not to satisfy the equations (1) and (2), the reliability of the color image is improved.

(Second Embodiment)

In the second embodiment, the condition that one of the marks 66K passes through any one of the contact areas 77 and the other marks 66K are not located at any contact area 77 at this time will be described with reference to FIGS. 9A and 0B. A contact area 77X of FIG. 9 is an arbitrary one of the contact area 77, and a contact area 77X2 is an arbitrary contact area 77 located on the downstream side of the contact area 77X1.

Figure 9A:
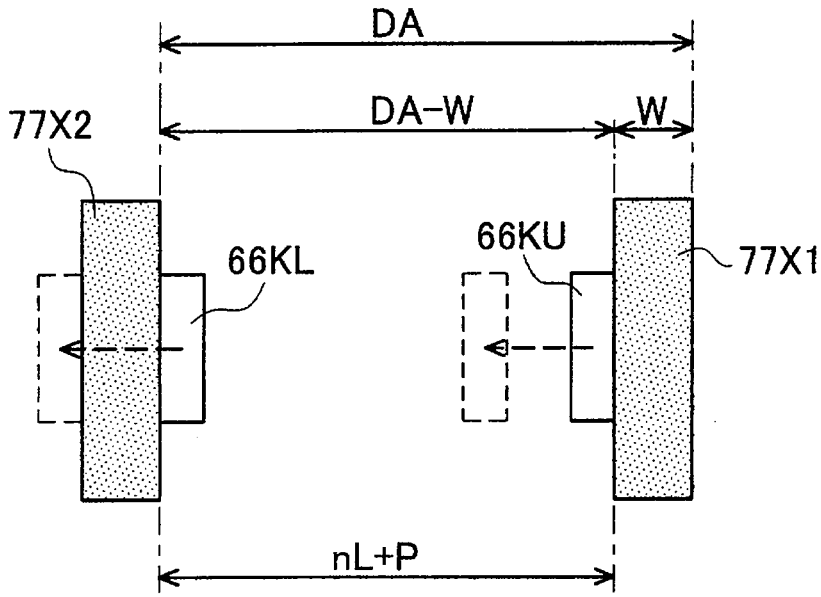
FIGS. 9A and 9B are diagrams illustrating conditions (3) and (4) that a mark surely overlaps with a contact area according to the second embodiment.

Therefore, first, a condition is obtained in which a mark 66KU, located on the downstream side (left of FIG. 9A) of the contact area 77X1, does not cross the contact area 77X1 while the mark 66KL, as a mark of other color K, passes through the contact area 77X2 as shown in FIG. 9A. The condition can be expressed by the following equation (3).

$$nL+P<DA-W \quad (3)$$

In the equation (3), A is an integer of 1 to 3, and n is a natural number.

Figure 9B:
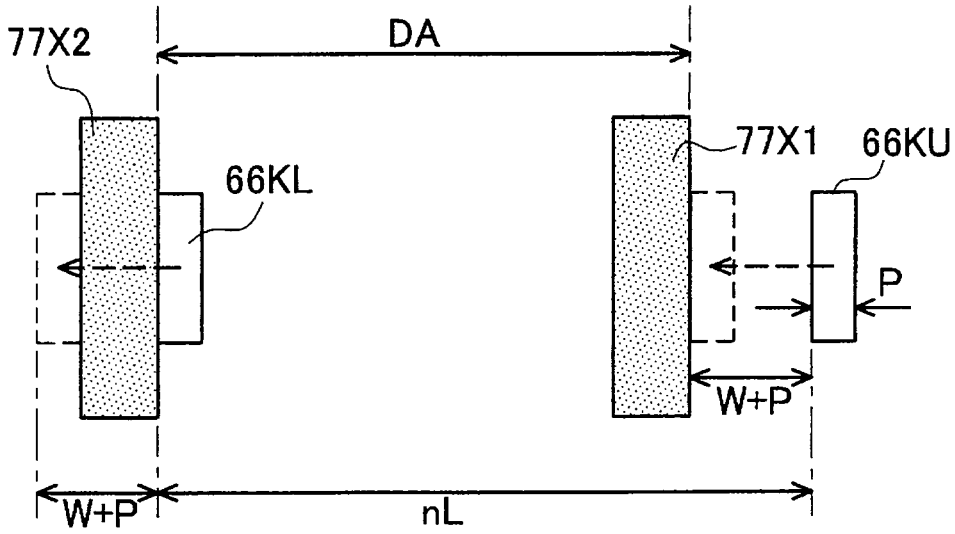

Next, a condition is obtained in which the mark 66KU, located on the upstream side (right of FIG. 9B) of the contact area 77X1, does not enter the contact area 77X1 while the mark 66KL, as a mark of other color K, passes through the contact area 77X2 as shown in FIG. 9B. The condition can be expressed by the following equation (4).

$$DA+W+P<nL \quad (4)$$

A of the equation (4) is an integer of 1 to 3, and n is a natural number.

Here, a certain natural number n needs to be set so that the distance from the mark 66K to the contact area 77 adjacent to the downstream side is not a predetermined distance or less, and the mark 66K is not included in the contact area 77 adjacent to the upstream side. Therefore, when A in equation (3) is replaced to have an equation for the value of A satisfying equation (4), the following equation (3') can be obtained.

$$nL+P<D(A+1)-W \quad (3')$$

when this equation is modified, the following equation (3") can be obtained.

$$nL<D(A+1)-W-P \quad (3'')$$

When the equations (4) and (3") are arranged, the following equation (5) can be obtained.

$$DA+W+P<nL<D(A+i)-W-P \quad (5)$$

When A=3 in the equation (5), there is no contact area 77 which is a target of the equation (3). For this reason, only the equation (4) may be used when A=3 ("3" is equal to the number of the contact areas 77−1, that is, the number B of the photosensitive units 1−1).

To sum up these, the condition that one of the marks 66K passes through the contact areas 77K, 77C, 77M, and 77Y, and the other marks 66K are not located in any contact area 77 at this time is as below.

Where n is set as a natural number of 1 to X−1, in condition α: $0<A\leq(B-1)$ an integer A satisfies $DA+W+P<nL<D(A+1)-W-P$ for all n, or in condition β: $A=B-1$, $DA+W+P<nL$ is satisfied for all n.

The width P and the interval L of the mark 66K are set so that there is an integer A satisfying the relationship above.

The condition above corresponds to the condition that a certain mark 66K of the marks 66K passes through the contact area 77, and the other marks 66K are not located at the contact area 77 at this time, that is, the condition that one of the marks 66K passes through the contact area 77, and the other marks 66K are not located at any contact area 77. Accordingly, when the interval L and the width P of the mark 66K are set so as to satisfy the condition above, the number of the marks 66K simultaneously existing in the contact areas 77K, 77C, 77M, and 77Y can be set to a maximum of one. As a result, the number of the marks 66K formed at the disturbance area 78 can be set to a maximum of one. Accordingly, the negative effects of the disturbance area 78 can be further alleviated compared with the first embodiment in which the number of the marks 66K simultaneously existing in the contact areas 77K, 77C, 77M, and 77Y is three at maximum.

Further, even in this embodiment, the mark 66K of color K is described, but the invention is not limited thereto. When the marks 66Y, 66M, and 66C of other colors are disposed in the same manner, detection precision for that color can be improved. When the marks of the four colors are formed so as not to satisfy the above-described equations, the reliability of the color image is improved.

(Third Embodiment)

In the third embodiment, the condition of combining the mark 66K with the marks of other colors is added to the condition of the first embodiment or the second embodiment.

As described above, in the positional offset correction using the resist pattern 66, the positional offset amount is obtained from a difference in the distance between the reference color (color K in this embodiment) and the adjustment color (colors YMC in this embodiment). For this reason, when the disturbance area exists in the mark of one of the reference color and the adjustment color, detection precision is degraded.

Figure 10:
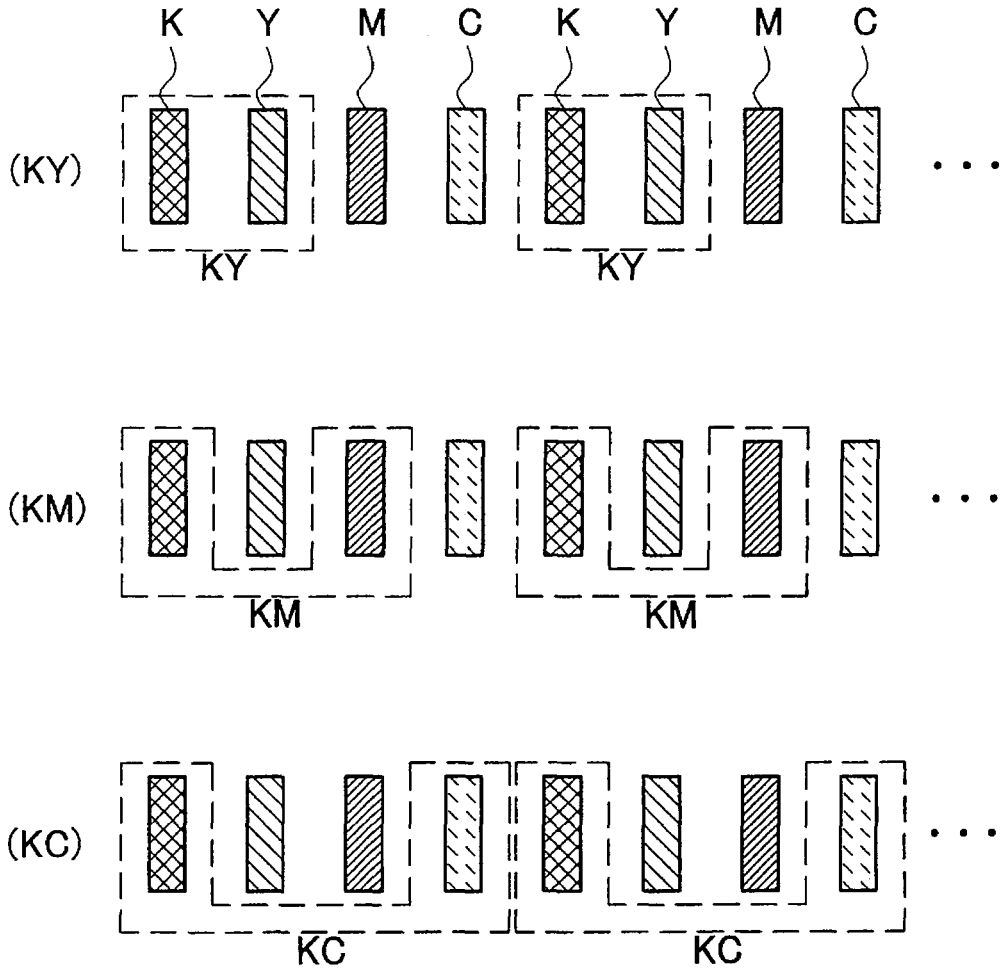
FIG. 10 is a diagram illustrating a combination of marks in a contact area according to the third embodiment.

Therefore, in this embodiment, the reference color and the adjustment color are regarded as a combination color pair. Specifically, in the copying machine 100, as shown in FIG. 10, there are three combination color pair of the combination color KY obtained from colors K and Y, the combination color pair KM obtained from colors K and M, and the combination color pair KC obtained from colors K and C.

As for at least one combination color of such combination color pair, the width P and the interval L of the transportation direction of the mark are set so that the mark of the color forming the color of the combination color pair does not exist in all the contact areas 77K, 77C, 77M, and 77Y. For example, as for the combination color pair KY, the width P and the interval L of the transportation direction of the marks 66K and 66Y are set so that the mark 66K or 66Y of the color forming the color of the combination color pair does not exist in all the contact areas 77K, 77C, 77M, and 77Y. Accordingly, the reliability for the positional offset detection is improved.

As for all combination color pairs, it is desirable that the width P and the interval L of the transportation direction of the mark are set so that the marks of the colors forming the color of the combination color pair do not exist in all the contact areas 77K, 77C, 77M, and 77Y. Accordingly, the reliability for the positional offset detection is further improved.

Further, in any one of the first to third embodiments, as for the interval L of the mark 66K, it is desirable that the integer multiples nL thereof is equal to the circumference length of the photosensitive unit 1. That is, in the copying machine 100, even when the photosensitive unit 1 is exposed by light so that the marks 66K are disposed at the same interval, a periodic difference caused by the eccentric component of the drum of the photosensitive unit 1 occurs in the interval of the marks 66K transferred onto the transportation belt 7. Therefore, when the interval L of the marks 66K is set so that the integer multiples nL of the interval L of the mark 66K is equal to the circumference length of the photosensitive unit 1, the eccentric component of the photosensitive unit 1 is easily corrected.

Setting Example of Resist Pattern

Subsequently, the detailed setting example of the interval L of the mark 66K will be described.

In this setting example, the other conditions for setting the interval L of the mark 66 are set as below.

The distance D between the photosensitive units 1=65 mm

The width W of the transportation direction of the contact area=2 mm

The width P of the transportation direction of the mark 66K=2 mm

The number B of the photosensitive units 1=4

First, in the equation (1) of the first embodiment, there is no range of the interval L satisfying the equation (1). On the other hand, the interval L of the mark 66K satisfying the equation (2) is as Table 1 below. For this reason, the condition of the first embodiment can be satisfied by setting the interval not satisfying the following range of L.

TABLE 1

| RANGE OF L (UNIT: mm) |
|---|
| 63.67~66.33 |
| 31.83~33.17 |
| 21.22~22.11 |
| 15.92~16.58 |
| 12.73~13.27 |
| 10.61~11.06 |
| 9.10~9.48 |
| 7.96~8.29 |
| 7.07~7.37 |
| 6.37~6.63 |
| 5.79~6.03 |
| 5.31~5.53 |
| 4.90~5.10 |
| 4.55~4.74 |
| 4.24~4.42 |

Next, the interval L of the mark 66K which can be set in the second embodiment under the same condition is as Table 2 below. The condition of the second embodiment can be satisfied by setting the interval satisfying the following range of L.

TABLE 2

| RANGE OF L (UNIT: mm) |
|---|
| 49.75~61.00 |
| 44.67~47.75 |
| 39.80~42.00 |
| 34.50~38.20 |
| 28.43~30.50 |
| 26.80~27.29 |
| 24.88~25.20 |
| 23.00~23.88 |
| 19.90~20.33 |

As described above in detail, the width P and the interval L of the transportation direction of the mark are set so that the mark of at least one color (for example, the mark 66K of the color K) does not simultaneously exist in the plurality of contact areas 77, that is, there is the contact area 77 where the mark of the color does not exist in at least one of the plurality of contact areas 77 even when the formation of the mark is started at a certain timing. Accordingly, it is possible to avoid a state where the mark of the color is simultaneously formed in the disturbance area 78. As a result, even when the position of the disturbance area 78 is not detected for at least the color, the negative effects caused by the disturbance area 78 can be alleviated.

This embodiment is merely an example, and the invention is not limited thereto. Accordingly, the invention can be corrected and modified variously within the scope of the spirit of the invention. For example, the invention is not limited to the copying machine, and also can be applied to an apparatus such as a printer, a facsimile machine, or a multi-functional apparatus having a color printing function.

Further, in this embodiment, it has been described that the surface of the transportation belt 7 becomes glossier as the influence of the disturbance area 78, but the invention is not limited thereto. For example, when the surface of the transportation belt 7 is subjected to a mirror plane process in advance, and the surface of the transportation belt 7 contacts with something, the gloss of the surface is reduced. Even in this case, the invention can be applied.

Furthermore, in this embodiment, the resist pattern 66 is formed by one bar-shaped mark, but the invention is not limited thereto. For example, a pair of bar-shaped marks may be formed, and at least one of them may be inclined only by a predetermined angle with respect to a line along the primary scanning direction. In this kind of resist pattern, the positional offset amount in the primary scanning direction can be specified together with the positional offset amount in the secondary scanning direction.

Moreover, in this embodiment, the number of the photosensitive units 1 is set to four so as to correspond to the number of the colors YMCK, but the invention is not limited thereto. That is, the invention can be applied if there is a plurality of photosensitive units, where the number of the photosensitive units may be three or fewer, or five or more.

Additionally, in this embodiment, it has been described that the resist pattern for correcting the positional offset amount is the mark formed on the transportation belt 7, but the invention is not limited thereto. For example, a concentration pattern may be used to correct a difference in the concentration.

Further, in this embodiment, the invention is applied to the image forming apparatus that forms the mark on the sheet transportation belt, but the invention is not limited thereto. For example, even in the image forming apparatus having an intermediate transfer belt, the invention can be applied when forming the mark on the intermediate transfer belt.

What is claimed is:

1. An image forming apparatus comprising:

a belt;

a plurality of photosensitive units configured to contact the belt are disposed at a predetermined interval in a transportation direction of the belt and transfer marks for image adjustment to the belt, images of different colors being respectively formed on the plurality of photosensitive units;

an exposure unit configured to expose the photosensitive units by light so that the marks are disposed at the same interval on the belt;

a detector configured to detect the marks transferred to the belt; and an image adjustment unit configured to perform an image adjustment based on a detection result of the detector, wherein a width and an interval of the marks in the transportation direction are set based on a width of a contact area between the belt and each photosensitive unit in the transportation direction so that a mark of at least one color does not exist in all contact areas of the belt contacting with the plurality of photosensitive units.

2. The image forming apparatus according to claim 1, wherein the width and the interval of the transportation direction of the marks are set so that the marks for each color do not exist in all the contact areas.

3. The image forming apparatus according to claim 1, wherein the width and the interval of the transportation direction of the marks are set so that, for at least one color, the number of the marks existing in the contact areas is one at maximum.

4. The image forming apparatus according to claim 1, wherein the width and the interval of the transportation direction of the marks are set so that, for all colors, the number of the marks existing in all the contact areas is one at maximum.

5. The image forming apparatus according to claim 1, wherein the image adjustment unit adjusts an image formation position, a reference color and an adjustment color are paired to define combination color pairs for detecting a correlation position of each color, and the width and the interval of the transportation direction of the marks are set so that the mark of the color forming a color of at least one of the combination color pairs does not exist in all the contact areas.

6. The image forming apparatus according to claim 5, wherein the width and the interval of the transportation direction of the marks are set so that the marks of the colors forming a color of all the combination color pairs do not exist in all the contact areas.

7. The image forming apparatus according to claim 5, wherein integer multiples of an interval of the marks is equal to a circumference length of the photosensitive unit.

8. An image forming apparatus comprising:

a belt;

a plurality of photosensitive units configured to contact the belt are disposed at a predetermined interval in a transportation direction of the belt and transfer marks for image adjustment to the belt, images of different colors being respectively formed on the plurality of photosensitive units;

an exposure unit configured to expose the photosensitive units by light so that the marks are disposed at the same interval on the belt;

a detector configured to detect the marks transferred to the belt; and an image adjustment unit configured to perform an image adjustment based on a detection result of the detector, wherein the following conditions are not satisfied:

$W>L-P$; and $D(B-1)+W+P>nL(B-1)>D(B-1)-W-P$ where n is a natural number and satisfies $N\leq X/(B-1)$, where L represents an interval of the marks, P represents a width of the marks in the transportation direction, D represents a distance between adjacent photosensitive units, W represents a width of a contact area between the belt and each photosensitive unit in the transportation direction, X represents a total number of the marks, and B represents a number of the photosensitive units.

9. An image forming apparatus comprising:

a belt;

a plurality of photosensitive units configured to contact the belt are disposed at a predetermined interval in a transportation direction of the belt and transfer marks for image adjustment to the belt, images of different colors being respectively formed on the plurality of photosensitive units;

an exposure unit configured to expose the photosensitive units by light so that the marks are disposed at the same interval on the belt;

a detector configured to detect the marks transferred to the belt; and an image adjustment unit configured to perform an image adjustment based on a detection result of the detector, wherein at least one of the following conditions is satisfied:

an integer A satisfying $DA+W+P<nL<D(A+1)-W-P$ for all n when $0<A\leq(B-1)$, and an integer A satisfying $DA+W+P<nL$ for all n when $A=B-1$, where L represents an interval of the marks, P represents a width of the marks in the transportation direction, D represents a distance between the photosensitive units, W represents a width of a contact area between the belt and each photosensitive unit in the transportation direction, X represents a total number of the marks, and B represents a number of the photosensitive units, and n is set to a natural number of 1 to $X-1$.

10. The image forming apparatus according to claim 1, wherein:

a plurality of disturbance areas exist on the belt, gloss of the disturbance areas on the belt being higher than gloss of the other areas on the belt; and at least one of the marks is not formed on the disturbance areas.

11. The image forming apparatus according to claim 1, wherein a plurality of the marks are formed on the belt for each of the colors.

* * * * *